US005201200A

United States Patent [19]

Hauber

[11] Patent Number: 5,201,200

[45] Date of Patent: Apr. 13, 1993

[54] READILY REVERSIBLE ENTRY LOCK WITH DOUBLE THROW DEAD BOLT AND SLAM LATCH LOCK

[76] Inventor: Peter Hauber, 9901 Helen Ave., Sunland, Calif. 91040

[21] Appl. No.: 717,993

[22] Filed: Jun. 20, 1991

[51] Int. Cl.[5] ..... E05B 59/00

[52] U.S. Cl. ..... 70/107; 70/143; 70/462

[58] Field of Search ..... 70/107-111, 70/141-144, 450, 451, 462, 129, 134; 292/142

[56] References Cited

U.S. PATENT DOCUMENTS 1,451,265 4/1923 Landing ..... 70/107
2,436,628 2/1948 Bratschi ..... 70/107 X
3,148,524 9/1964 Yolkowski ..... 70/107
3,222,898 12/1965 Lunsford ..... 292/142 X
3,266,276 8/1966 Yulkowski ..... 70/110
3,759,074 9/1973 Prahl ..... 70/143
4,696,174 9/1987 Marks ..... 70/462 X

*Primary Examiner*—Peter M. Cuomo
*Assistant Examiner*—Suzanne L. Dino
*Attorney, Agent, or Firm*—Louis J. Bachand

[57] ABSTRACT

An entry lock assembly comprising a dead bolt incrementally extendible by successive turns of a key, a slam bolt which is bodily reversible and blocked against retraction by the dead bolt when extended, and a lock face plate which is bodily reversible, for rehanding the lock.

30 Claims, 4 Drawing Sheets

READILY REVERSIBLE ENTRY LOCK WITH DOUBLE THROW DEAD BOLT AND SLAM LATCH LOCK

FIELD OF THE INVENTION

This invention has to do with locks and more particularly with entry door locks having both a dead bolt and a slam latch. The invention provides improvements in entry locks including an extended throw dead bolt, blocking of retraction of the slam latch by extension of the dead bolt so that the slam latch functions as a dead bolt, and ready reversal of lock assembly hand by only simple inverting adjustment of the slam bolt and the face plate.

BACKGROUND OF THE INVENTION

Entry locks are used on larger doors of buildings, especially the front doors of dwellings. Typically, they include key and tab operated dead bolts, and handle operated slam latches which engage an opposed keeper immediately upon closure of the door. The dead bolt is desirably extended at least one inch into the keeper, for security, such extension being referred to herein as a one inch throw. An actuating mechanism within the lock provides the means for the dead bolt throw; such mechanisms have been limited in the past to modest throws unless complicated mechanical arrangements are employed. Complex arrangements wear unduly and are not fully reliable over time.

It is an object, therefore, of the present invention to provide an entry lock in which long throws of the dead bolt are achieved by a simple, reliable mechanism not prone to wear.

Entry lock slam latches can typically be pushed back although the dead bolt is extended.

It is another object of the invention to prevent such unwanted retraction of the slam latch by blocking retractive movement of the slam latch when the dead bolt is extended by simple means provided on the dead bolt.

Another consideration in the utility of locks is the ease of converting them for use on both left and right hand opening doors.

It is another object of the present invention to provide an entry lock which is readily reversed as to left or right handedness.

SUMMARY OF THE INVENTION

These and other objects of the invention to become apparent hereinafter are realized in the invention entry lock assembly comprising a housing adapted to installation on a door jamb, a dead bolt mounted in the housing for reciprocal translational movement to and from the housing, and a dead bolt actuator, the dead bolt actuator comprising a pawl mounted for angular movement along a predetermined path, the dead bolt comprising an elongated bar having a plurality of steps for engaging the pawl for dead bolt movement, the steps being spaced from one another a distance enabling their successively separately engaging the pawl responsive to successive angular movements of the pawl, whereby translational movement of the dead bolt is effected in a plurality of successive increments responsive to successive pawl engagements with successive ones of the steps.

It will be evident from the foregoing that the invention involves a multiple movement of the dead bolt actuator so as to multiply act on the dead bolt, each action producing a separate movement of the dead bolt; the result is a multiple throw of the dead bolt and an increased extension into the keeper, without complicated mechanisms.

In the just mentioned embodiment, typically: the elongated bar has two longitudinally spaced steps for effecting two increments of dead bolt movement; the actuator pawl is mounted to rotate 360 degrees in either direction and to engage the steps separately and successively with each rotation; the path of pawl movement lies in the same plane as that in which the dead bolt moves; there is also included spring means yieldingly biasing the pawl during step engagement.

In particular embodiments, the steps each comprise a recess in the longitudinal edge of the elongated bar sized to receive the pawl moving angularly in step-engaged relation, and the pawl engages the front or rear walls of the step recess to effect dead bolt movement forward or backward respectively, the walls being chamfered at their transition to the bar longitudinal edge along the path of angular movement of the pawl.

In a particularly preferred embodiment of the entry lock assembly, the housing is vertically elongated, the dead bolt actuator is located in the upper portion of the housing, the actuator pawl is downwardly descending, the dead bolt elongated bar is located below the actuator, and the steps each comprise an upwardly open rectangular recess in the longitudinal bar for receiving the pawl in engaged relation.

In this and like embodiments there is further included: means yieldingly biasing the pawl during step engagement; ways defined by the elongated bar below and on either side of each the step recess, a saddle slidably mounted in the ways, spring means biasing the saddle upward within the step, saddle retaining means blocking saddle movement beyond the step recess, the saddle resiliently biasing the pawl during pawl engagement with the step; stop means carried by the elongated bar against movement beyond the housing; and a guideway formed by vertically separated flanges within the housing, the guideway slidably mounting the dead bolt elongated bar for horizontal translational movement effected by the pawl engaging the steps while moving angularly; the upper of the guideway defining flanges being interupted to permit pawl movement into engagement with the steps.

In yet another embodiment: the elongated bar rearwardly defines a stop means, the stop means cooperating with a guideway defining flange to block unwanted outward movement of the dead bolt; the dead bolt actuator pawl is mounted to rotate through 360 degrees and engages a step at each rotation, advancing or retracting the dead bolt one increment for each rotation depending on the direction of rotation; the rotation of the pawl is key-controlled; the elongated bar has two longitudinally spaced steps for effecting two increments of dead bolt movement; the path of pawl movement lies in the same plane as that in which the dead bolt moves; there is further included spring means yieldingly biasing the pawl during step engagement; the steps each comprise a recess in the upper longitudinal edge of the elongated bar sized to receive the pawl moving angularly in step-engaged relation; there is further included ways defined by the elongated bar below and on either side of each the step recess, a saddle slidably mounted in the ways, return spring means biasing the saddle upward within the step, saddle retaining means blocking saddle movement beyond the step recess, the saddle resiliently biasing the pawl during pawl engagement with the step; and the pawl engages the front or rear walls of the step recess to effect dead bolt movement forward or backward respectively, the walls being chamfered at their transition to the bar longitudinal edge along the path of angular movement of the pawl.

In another embodiment of the invention, there is further included a slam latch mounted in the housing, spring means biasing the slam latch outward, and a slam latch actuator for retracting the slam latch against its biasing spring, the slam latch actuator being torsion spring loaded against slam latch retraction actuation.

In this and like embodiments, there is further included stop means carried rearwardly by the dead bolt elongated bar, the stop means acting on the slam latch to arrest return movement of the slam latch when the dead bolt is engaged beyond the housing.

In another embodiment, there is provided an entry lock assembly comprising a housing, a dead bolt extendible from the housing to a locking position, and a slam latch extendible in the plane of the dead bolt to a locking position, and cooperating means on the dead bolt and the slam latch blocking return of the slam latch when the dead bolt is extended to a locking position.

In this and like embodiments, the slam latch typically comprises an elongated bar having a tapered end face, and there is also included spring means biasing the slam latch outward, and a slam latch actuator for retracting the slam latch against its biasing spring, the slam latch being torsion spring loaded against slam latch retraction actuation; the dead bolt comprises an elongated bar having a step for advancing or retracting the latch in pawl-engaged relation, the dead bolt elongated bar including a stop shoulder rearward of the step for engaging the slam latch elongated bar in cooperating relation against return of the slam latch before the dead bolt bar is returned; the slam latch body defines an actuator receiving lateral recess on its oppositely facing sides for receiving the actuator alternatively in bodily inverted positions, the slam latch body is reversible by bodily inverting the slam latch, and there is further included a dead bolt and slam latch passing face plate adapted for ready reversal of hand, the face plate having symmetrical upper and lower halves and an inwardly increasing wedge-shape in cross-section arranged for reverse handing by bodily inverting the face plate, whereby the entry lock assembly is readily right or left handed.

In a highly preferred embodiment, the invention provides an entry lock assembly comprising a vertically elongated rectangular housing having means to mount a dead bolt and a slam latch, the dead bolt comprising an elongated bar, the dead bolt mounting means comprising vertically spaced upper and middle flanges extending inward in the housing in dead bolt elongated bar bracketing relation, a slam latch comprising an elongated bar having a tapered face, the slam latch mounting means comprising vertically spaced middle and lower flanges extending inward in the housing in slam latch elongated bar bracketing relation, the slam latch being spring biased outward from the housing, a slam latch retraction actuator for retracting the slam latch and limiting outward movement of the slam latch to a predetermined amount, retraction actuator engagement means comprising a recess formed on the slam latch elongated bar, a post blocking disengagement of the retraction actuator from the slam latch elongated bar, the post being removable only from within the housing; a dead bolt actuator comprising a pawl rotatable about a point responsive to key control, the upper housing flange being interrupted to accommodate pawl movement, a pair of steps formed by longitudinally adjacent, upwardly opening recesses in the dead bolt elongated bar, the pawl being engageable with the steps separately and in succession in the course of two complete rotations, whereby the dead bolt is twice shifted translationally in the direction of pawl rotation by two rotations of the pawl.

Typically in this embodiment, the slam latch elongated bar has an actuator receiving recess on either side thereof, whereby the hand of the slam latch can be reversed by removing the slam latch actuator from engagement with the slam latch elongated bar recesses and bodily inverting, and including also a face plate having a wedge-shaped taper and symmetry of openings on its top and bottom halves, whereby the face plate is hand reversible by bodily inverting, the lock assembly being thereby readily reversed as to hand; and there is further included means carried by the dead bolt blocking unlatching movement of the slam latch rearward beyond the dead bolt means.

THE DRAWING

The invention will be more particularly described in conjunction with the attached drawing in which.

PREFERRED MODES

With reference now to the drawings, particularly to FIGS. 1–6, 2 5 and 6 the lock is shown at 10 and includes a generally rectangular, vertically elongated housing 12 which acts as a frame for mounting the lock components. The housing 12 comprises screwed together mating panels, 14, 16 shown.

Figure 1:
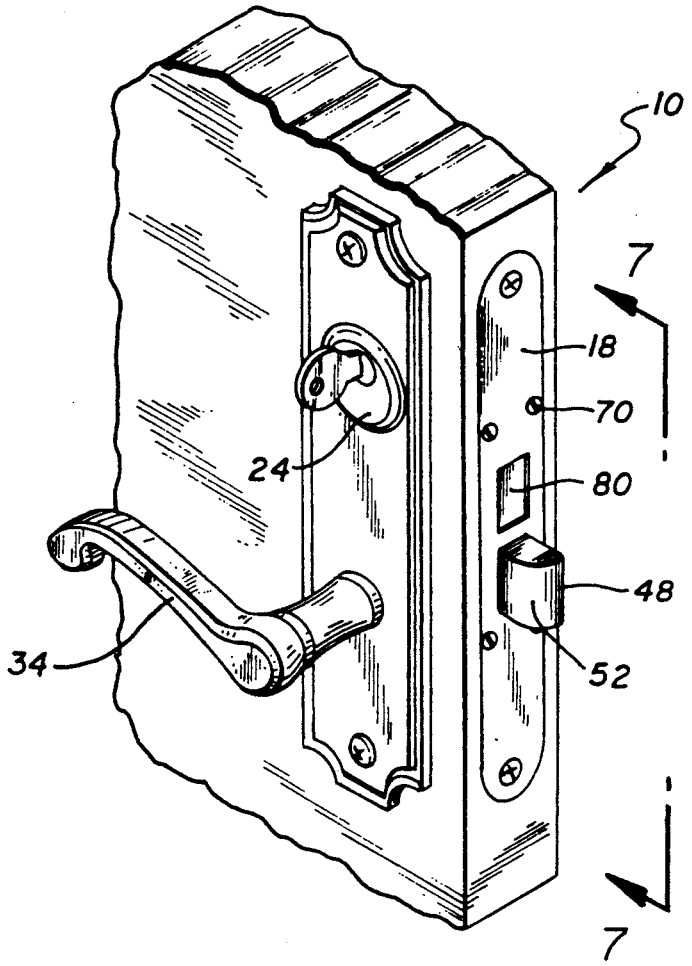
FIG. 1 is a perspective view of the entry lock assembly.
Figure 7:
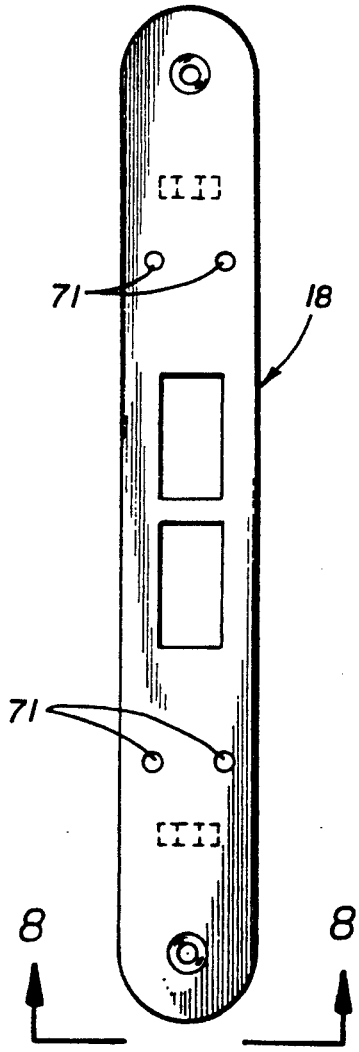
FIG. 7 is an elevational view of the face plate.
Figure 8:
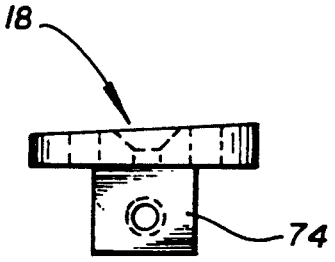
FIG. 8 is a bottom view taken on line 8—8 in FIG. 7.
Figure 5:
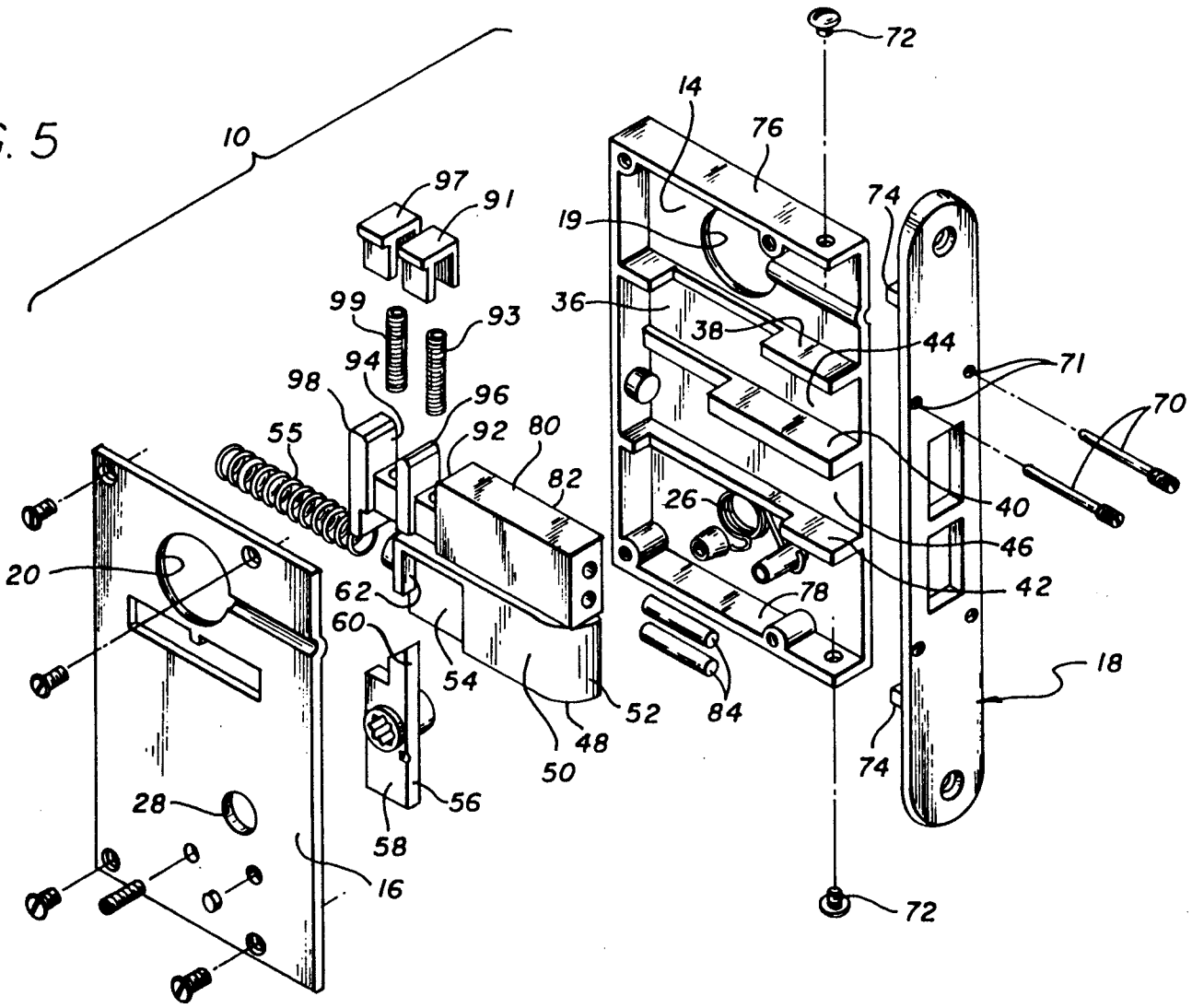
FIG. 5 is an exploded view of the lock portion.
Figure 6:
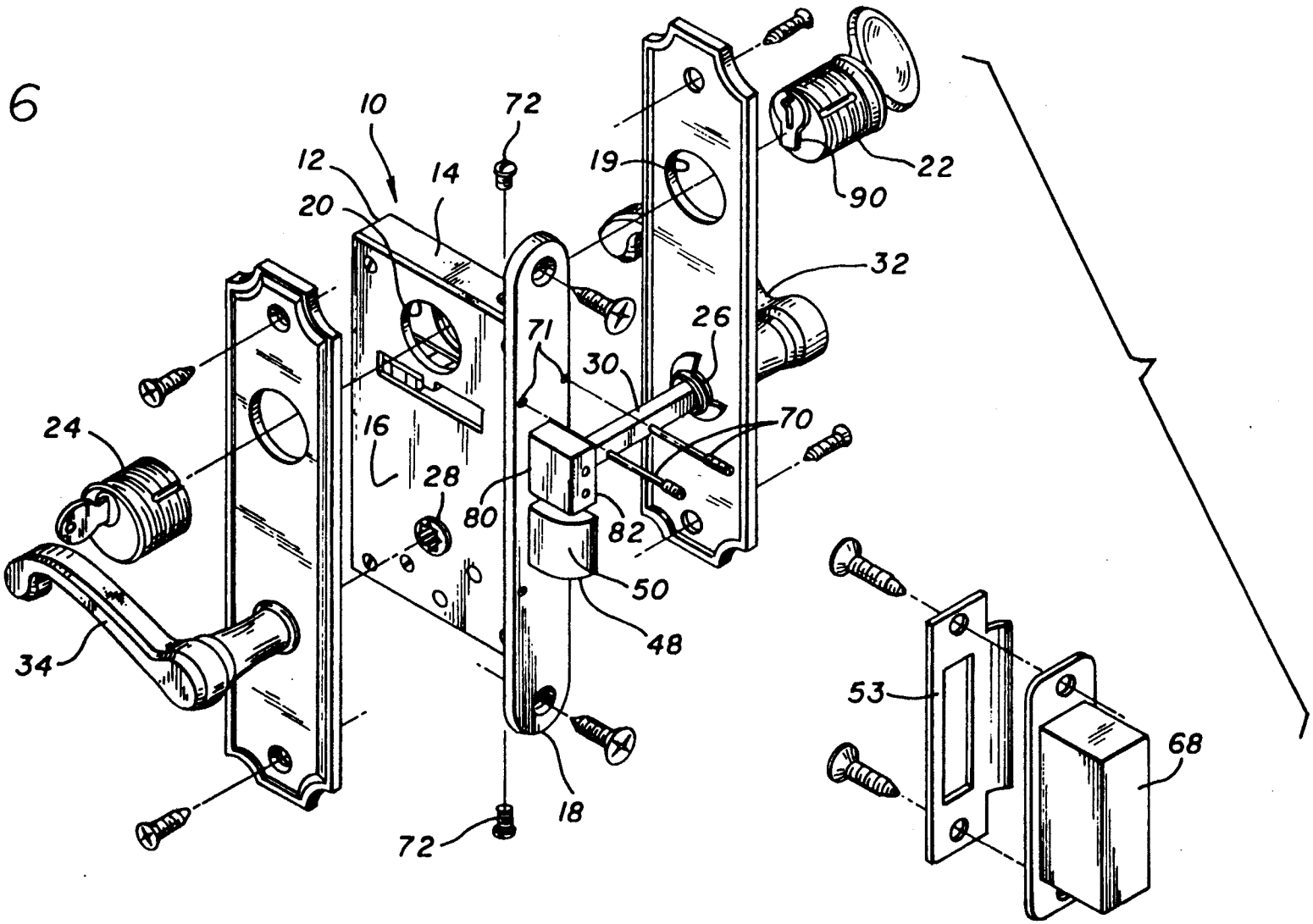
FIG. 6 is an exploded view of the entry lock assembly.

As best shown in FIG. 5, the lock assembly includes the panels 14, 16, which are adapted to be screwed together, a face plate 18 which is wedge shaped in cross-section, (shown in FIG. 8) tapering outward toward the inner part of the door on which the lock assembly is mounted (not shown) for purposes to appear. The lock assembly housing panels 14, 16 have opposed upper openings 19, 20 which are threaded to receive lock cylinders 22, 24 (FIG. 6), opposed lower openings 26, 28 through which in which a lever shaft 30 (FIG. 6) passes through the housing, lever handles 32, 34 (FIG. 6) being secured to the shaft.

Housing panel 14 has formed on its inner surface 36 an upper flange 38, a middle flange 40, and a lower flange 42, all of which are normally horizontal and vertically separated as shown. The vertical separation of upper flange 38 and middle flange 40 defines a dead bolt guideway 44 in which the dead bolt of the lock assembly is mounted as will be described below. The vertical separation of middle flange 40 and lower flange 42 defines a slam latch guideway 46 in which the slam latch of the lock assembly is mounted. It will be noted that middle flange 40 separates the guideways 44, 46 and that the guideways are closely proximate. The vertical proximity a co-planarity of the guideways 44, 46, enables the dead bolt to be used to block retraction of the slam latch as will be described below.

The slam latch 48 comprises an elongated bar 50 disposed horizontally in guideway 46 for sliding movement. The face 52 of the slam latch bar 50 is sloped with a taper or radius away from the direction of door movement to facilitate deflection of the slam latch by the striker 53 as the door is closed. Elongated bar 50 has a pair of lateral recesses 54 on either side of the bar toward the rear thereof. Compression spring 55 supported by bosses 57 urges the slam latch 48 outward. The recesses 54 are shaped to engage the slam latch retractor 56, a pivoted arm 58 having finger 60, which bears against the rearward portion 62 of the recess 54. Retractor 56 is fixed to lever shaft 30 for angular movement responsive to turning of lever handles 32, 34. Such lever handle 32, 34 movement causes the shaft 30 to turn, the retractor arm 58 to pivot, and the retractor finger 60 to push on the slam latch bar 50 at its recess 54. Such pressure, made against the torsion spring 66 which preloads the arm 58, and the compression spring 55, retracts the bar 50 and disengages the slam latch 48 from its keeper 68.

The recesses 54 are reversed in shape on opposite sides of the bar 50 so that the bar may be reversed, causing the bar face 52 to be reversed, e.g. for a left opening door rather than a right opening door, or vice-versa. In either case the recesses 54 are such that the finger 60 will engage them whichever is presented to the finger, so that the slam latch 48 can be reversed as to hand by bodily inverting it.

Figure 2:
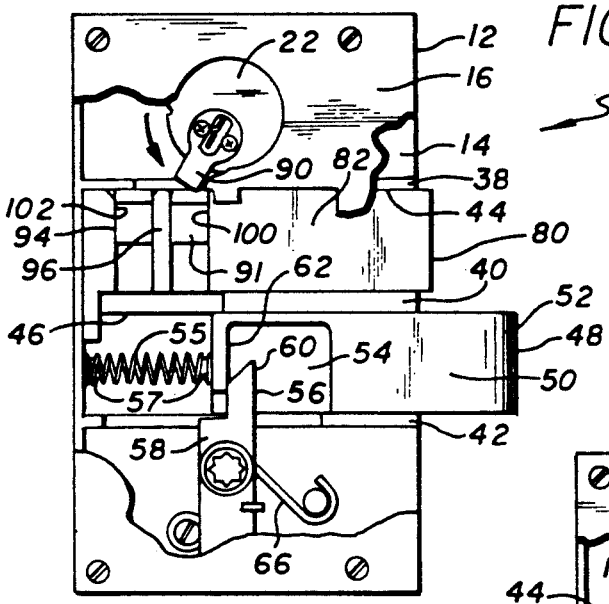
FIG. 2 is a view in vertical section of the lock portion of the entry lock assembly, with the dead bolt fully retracted.

The slam latch 48 is slidably mounted in guideway 46 and being spring loaded by compression spring 55 will always be projecting from the housing, See FIG. 2, limited in its travel outward by finger 60, unless being retracted by operation of lever handles 32, 34.

The face plate 18 is mounted to the housing panel 14 by screws 72 passing through the panel and into upper and lower mounting flanges 74, which snugly interfit with the upper and lower walls 76, 78 of housing panel 14. The face plate 18 is tapered to have a wedge shape in cross section, with increasing thickness away from the direction of door closing movement, so as to closely fit in the door jamb. The face plate 18 is made with its upper and lower halves symmetrical so that to reverse the door hand the face plate is simply bodily inverted, and this reverses the taper to be suited for reverse door hand. Retaining openings 71 are duplicated above and below for receiving mounting screws 70.

The dead bolt 80 comprises an elongated bar 82 which is generally rectangular in longitudinal and transverse cross section; it is provided endwise with pins 84 (FIG. 5) against cutting through the bar. The overall size and rectangular outline of the dead bolt 80 and slam latch 48 are approximately the same. The dead bolt bar 82 is positioned just above and in the same plane as the slam latch 48 separated vertically by the thickness of the middle flange 40, and held in guideway 44 for sliding reciprocal movement.

Movement of dead bolt bar 82 is effected by pawl 90 of cylinder lock 22 acting against the bar. The dead bolt bar 82 has steps 92, 94 formed therein open upwardly in the longitudinal upper wall 95 of the bar 82. The steps 92, 94 are longitudinally spaced across a land 96, and placed toward the rearward portion 98 of the bar 82. The placement and depth of the steps 92, 94 is determined by the requirement to have pawl 90 intersect with the steps so as to engage the step 92 front wall 100, or step 94 rear wall 102. It will be noted that pawl 90 is mounted in the lower half of lock cylinder 22. The pawl is mounted for rotational movement through 360 degrees, by a key or a tab depending on whether the cylinder is inside or outside the door. Rotation of the lock cylinder key or tab causes rotation of the pawl 90.

Figure 3:
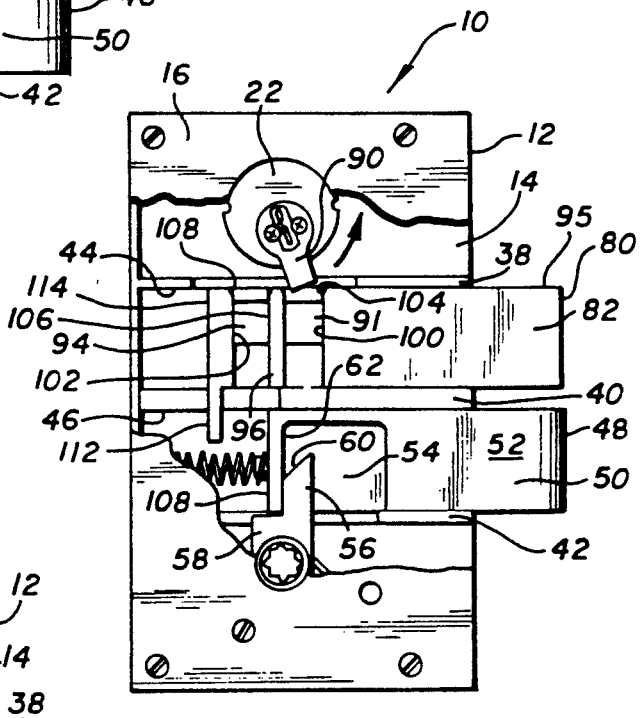
FIG. 3 is a view like FIG. 2, showing the first stage of dead bolt extension.
Figure 4:
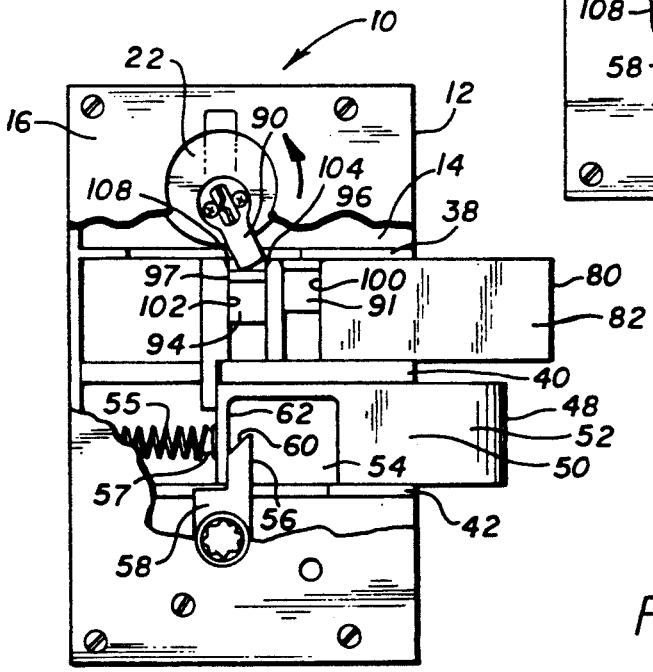
FIG. 4 is a view like FIG. 2, showing the second stage of dead bolt extension.

With reference to FIGS. 2, 3 and 4, the pawl 90 is downwardly depending and slightly rearwardly directed when the dead bolt 80 is fully withdrawn, as shown in FIG. 2. The pawl 90 is inserted in first step 92. The slam latch 48 is fully extended. This is the normal condition of the lock assembly before the dead bolt 80 is thrown. In FIG. 3, the pawl 90 has been rotated a few degrees to depress saddle 91 against its return spring 93 (FIG. 5). Such rotation, effected by a key or thumbturn, when continued causes the pawl 90 to engage front wall 100 of the first step 92 and push the dead bolt bar 82 outward a first extended increment beyond housing 12 (FIG. 3). The chamfering of the step wall 100 at its transition to the upper wall 95 of the bar 82, shown at 104, enables the pawl 90 to smoothly clear the step 92 with a predetermined advance of the dead bolt 80, as depicted in FIG. 2. Following the pawl 90 clearing the step 92, counterclockwise rotation of the pawl is continued, a full 360 degrees. Upon return to the position shown in FIG. 1, the pawl now engages the front wall 106 of the second step 94, the second step having been indexed forward by the advance of the bar 82 by the first pawl 90 engagement just described, sufficiently to place the second step in the former position of the first step. There, the bar 82 advancement is repeated as the pawl moves past chamfered second step rear wall 108 edge, into the step 94, engages the saddle 97, depressing it against return spring 99, and continues into engagement with second step front wall 110, thereby indexing the dead bolt 80 another, second extended increment forward beyond the housing 12, as shown in comparing FIG. 3 and FIG. 4. Upon full extension of the dead bolt 80 by the two successive incremental projections each beyond the housing 12 the pawl 90 is poised to engage the rear wall 102 of step 94, and the above increments of dead bolt movement are reversed as the pawl is rotated clockwise. While two steps 92, 94, and two rotations of the pawl 90, and correspondingly a double throw of the dead bolt 80 have been described, this embodiment is illustrative as other numbers of steps, rotations, part rotations, and increments of indexing could also be employed.

The dead bolt bar 82 has a stop 112 fixed thereto, and preferably integrated therewith, at the rearward face 114 of the bar. Suitably, the stop 112 is a continued extent of the bar 82 rearward face. The stop 112 extends into the plane of movement of the slam latch 48, such that the slam latch cannot retract farther than the dead bolt. In FIG. 3, for example, as the dead bolt 80 is advanced to its maximum extension, the stop 112 will abut the rearward face 108 of the slam latch bar 50, and effectively block any retraction of the bar from forces outside the lock assembly.

The result is a doubling of the dead bolt protection as the slam latch is converted into a dead bolt. This, combined with the double extension of the dead bolt 80 provides maximum security in an entry lock.

The objectives of the invention are thus met in the described entry lock assembly, including long throws of the dead bolt achieved by a simple, reliable mechanism not prone to wear, unwanted retraction of the slam latch is prevented by blocking retractive movement of the slam latch when the dead bolt is extended by a simple stop means provided on the dead bolt, and the entry lock is readily reversed as to left or right handedness by rearrangement of just the face plate and slam latch.

I claim:

1. An entry lock assembly comprising a housing adapted for installation on a door jamb, a slam latch mounted in said housing a dead bolt mounted in said housing for reciprocal translational movement to and from the housing, a dead bolt actuator, said dead bolt actuator comprising a pawl mounted for multiple turns of angular movement along a predetermined path, said dead bolt comprising an elongated bar having a plurality of steps for engaging said pawl for dead bolt movement, said steps being longitudinally spaced from one another a distance enabling their successive angular movements of said pawl in one direction whereby progressive translational movement of said dead bolt in one direction is effected in a plurality of successive increments each projecting said deadbolt beyond said housing responsive to successive pawl engagement with successive ones of said steps, and stop means carried rearwardly by said dead bolt elongated bar, said stop means acting on said latch to arrest return movement of said slam latch when said dead bolt is engaged beyond said housing.

2. The entry lock assembly according to claim 1, in which said elongated bar has two longitudinally spaced steps for effecting two increments of dead bolt movement upon two turns of said pawl.

3. The entry lock assembly according to claim 1, in which said actuator pawl is mounted to rotate 360 degrees in either direction on each turn and to engage said steps separately and successively with each rotation.

4. The entry lock assembly according to claim 1, in which said path of pawl movement lies in the same plane as that in which said dead bolt moves.

5. The entry lock assembly according to claim 1, including also spring means yieldingly biasing said pawl during step engagement.

6. The entry lock assembly according to claim 1, in which said steps each comprise a recess in the longitudinal edge of said elongated bar sized to receive said pawl moving angularly in step-engaged relation.

7. The entry lock assembly according to claim 6, in which said pawl engages said recess front or rear walls of said step recess to effect dead bolt movement forward or backward respectively, said walls being chamfered at their transition to said bar longitudinal edge along the path of angular movement of said pawl.

8. The entry lock assembly according to claim 1, in which said housing is vertically elongated, said dead bolt actuator is located in the upper portion of said housing, said actuator pawl is downwardly descending, said dead bolt elongated bar is located below said actuator, and said steps each comprise an upwardly open rectangular recess in said longitudinal bar for receiving said pawl in engaged relation.

9. The entry lock assembly according to claim 8, including also means yieldingly biasing said pawl during step engagement.

10. The entry lock assembly according to claim 8, including also ways defined by said elongated bar below and on either side of each said step recess, a saddle slidably mounted in said ways, spring means biasing said saddle upward within said step, saddle retaining means blocking saddle movement beyond said step recess, said saddle resiliently biasing said pawl during pawl engagement with said step.

11. The entry lock assembly according to claim 10, including also stop means carried by said elongated bar against movement beyond said housing.

12. The entry lock assembly according to claim 8, including also a guideway formed by vertically separated flanges within said housing, said guideway slidably mounting said dead bolt elongated bar for horizontal translational movement effected by said pawl engaging said steps while moving angularly.

13. The entry lock assembly according to claim 12, in which the upper of said guideway defining flanges is interrupted to permit pawl movement into engagement with said steps.

14. The entry lock assembly according to claim 13, in which said elongated bar rearwardly defines a stop means, said stop means cooperating with the lower of said flanges to block unwanted outward movement of said dead bolt.

15. The entry lock assembly according to claim 13, in which said dead bolt actuator pawl is mounted to rotate through 360 degrees and engages a step at each rotation, advancing said dead bolt one increment beyond said housing for each rotation.

16. The entry lock assembly according to claim 15, in which the rotation of said pawl is key-controlled.

17. The entry lock assembly according to claim 16, in which said dead bolt elongated bar has two longitudinally spaced steps for effecting two increments of dead bolt movement.

18. The entry lock assembly according to claim 17, in which said path of pawl movement lies in the same plane as that in which said dead bolt moves.

19. The entry lock assembly according to claim 18, including also spring means yieldingly biasing said pawl during step engagement.

20. The entry lock assembly according to claim 19, in which said steps each comprise a recess in the upper longitudinal edge of said elongated bar sized to receive said pawl moving angularly in step-engaged relation.

21. The entry lock assembly according to claim 20, including also ways defined by said elongated bar below and on either side of each said step recess, a saddle slidably mounted in said ways, spring means biasing said saddle upward within said step, saddle retaining means blocking saddle movement beyond said step recess, said saddle resiliently biasing said pawl during pawl engagement with said step.

22. The entry lock assembly according to claim 21, in which said pawl engages said recess front or rear walls of said step recess to effect dead bolt movement forward or backward respectively, said walls being chamfered at their transition to said bar longitudinal edge along the path of angular movement of said pawl.

23. The entry lock assembly according to claim 21, including also said slam latch mounted in said housing in the plane of said dead bolt elongated bar, spring means biasing said slam latch outward, and a slam latch actuator for retracting said slam latch against its biasing spring, said slam latch actuator being torsion spring loaded against slam latch retraction actuation.

24. An entry lock assembly comprising a housing, a dead bolt, having multiple steps, incrementally extendible beyond said housing by each of said multiple steps to a locking position, and a slam latch extendible in the plane of said dead bolt to a locking position, and cooperating means on said dead bolt and said slam latch blocking return of said slam latch when said dead bolt is extended to a locking position, wherein said dead bolt comprises an elongated bar having a step for advancing or retracting said latch in pawl-engaged relation, said dead bolt elongated bar including a stop shoulder rearward of said step for engaging a slam latch elongated bar in cooperating relation against return of said slam latch bar before said dead bolt bar is returned.

25. The entry lock assembly according to claim 24, in which said slam latch comprises an elongated bar having a tapered end face, and including also spring means biasing said slam latch outward, and a slam latch actuator for retracting said slam latch against its biasing spring, said slam latch actuator being torsion spring loaded against slam latch retraction actuation.

26. The entry lock assembly according to claim 25, in which said slam latch elongated bar defines an actuator receiving lateral recess on its oppositely facing sides for receiving said actuator alternatively in bodily inverted positions.

27. The entry lock assembly according to claim 26, in which said slam latch body is reversible by bodily inverting the slam latch, and including also a dead bolt and slam latch passing face plate adapted for ready reversal of hand, said face plate having symmetrical upper and lower halves and an inwardly increasing wedge-shape in cross-section arranged for reverse handing by bodily inverting the face plate, whereby said entry lock assembly is readily right or left handed.

28. An entry lock assembly comprising a vertically elongated rectangular housing having means to mount a dead bolt and a slam latch, a dead bolt comprising an elongated bar, said dead bolt mounting means comprising vertically spaced upper and middle flanges extending inward in the housing in dead bolt elongated bar bracketing relation, a slam latch bolt comprising an elongated bar having a tapered face, said slam latch mounting means comprising vertically spaced middle and lower flanges extending inward in the housing in slam latch elongated bar bracketing relation, said slam latch being spring based outward from said housing, a slam latch bolt retraction actuator for retracting said slam latch bolt and limiting outward movement of said slam latch bolt to a predetermined amount, retraction actuator engagement means comprising a recess formed on said slam latch elongated bar, a post blocking disengagement of said retraction actuator from said slam latch elongated bar, said post being removable only from within said housing; a dead bolt actuator comprising a pawl rotatable about a point responsive to key control, said upper housing flange being interrupted to accommodate pawl movement, a pair of steps formed by longitudinally adjacent, upwardly opening recessed in said dead bolt elongated bar, said pawl being engageable with said steps separately and in succession in the course of two complete rotations, whereby said dead bolt is twice shifted translationally beyond or into the housing respectively in the direction of pawl rotation by two rotations of said pawl.

29. Entry lock assembly according to claim 28, in which said slam latch elongated bar has an actuator receiving recess on either side thereof, whereby the hand of said slam latch can be reversed removing the said slam latch actuator from engagement with said slam latch elongated bar recesses and bodily inverting, and including also a face plate having a wedge-shaped taper and symmetry of openings on its top and bottom halves, whereby said face plate is hand reversible by bodily inverting, the lock assembly being thereby readily reversed as to hand.

30. Entry lock assembly according to claim 28, including also means carried by said dead bolt blocking unlatching movement of said slam latch bar rearward beyond said dead bolt means.

* * * * *